US010061265B2

(12) United States Patent
Watatani

(10) Patent No.: US 10,061,265 B2
(45) Date of Patent: Aug. 28, 2018

(54) IMAGE FORMING APPARATUS INCLUDING A FIXING UNIT WHICH FIXES A TONER IMAGE ON A RECORDING MEDIUM

(71) Applicant: KYOCERA Document Solutions Inc., Osaka (JP)

(72) Inventor: Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/653,983

(22) Filed: Jul. 19, 2017

(65) Prior Publication Data

US 2018/0032028 A1 Feb. 1, 2018

(30) Foreign Application Priority Data

Jul. 29, 2016 (JP) ..... 2016-149894

(51) Int. Cl.
*G03G 21/16* (2006.01)
*G03G 15/20* (2006.01)

(52) U.S. Cl.
CPC ..... *G03G 21/1685* (2013.01); *G03G 15/2017* (2013.01); *G03G 15/2067* (2013.01); *G03G 21/1647* (2013.01); *G03G 15/2035* (2013.01)

(58) Field of Classification Search
CPC ..... G03G 15/2017; G03G 21/1647; G03G 21/1685
See application file for complete search history.

(56) References Cited

U.S. PATENT DOCUMENTS

2015/0071680 A1* 3/2015 Fukuda ..... G03G 21/1685 399/122
2016/0209802 A1* 7/2016 Yoshida ..... G03G 21/1647

FOREIGN PATENT DOCUMENTS

JP 04-269767 A 9/1992
JP 2004-157429 A 6/2004

* cited by examiner

*Primary Examiner* — Sandra Brase

(74) *Attorney, Agent, or Firm* — Studebaker & Brackett PC

(57) ABSTRACT

An image forming apparatus includes a fixing unit and an apparatus main body. The fixing unit fixes a toner image on a recording medium. To the apparatus main body, the fixing unit is attached. The apparatus main body includes a holding part which has an opening and an elastically deformable contact part. The opening is arranged at an attachment position of the fixing unit. The contact part protrudes from an edge of the opening to an attachment direction of the fixing unit and is bent so as to narrow the opening. The fixing unit includes a held part protruding at a position corresponding to the holding part, and the held part enters the opening while pressing the contact part so that the held part fits into the opening.

7 Claims, 17 Drawing Sheets

IMAGE FORMING APPARATUS INCLUDING A FIXING UNIT WHICH FIXES A TONER IMAGE ON A RECORDING MEDIUM

This application is based on and claims the benefit of priority from Japanese patent application No. 2016-149894 filed on Jul. 29, 2016, which is incorporated by reference in its entirety.

BACKGROUND

The present disclosure relates to an image forming apparatus including a fixing unit which fixes a toner image on a recording medium.

Conventionally, an electrographic image forming apparatus includes a fixing unit which fixes a toner image on a recording medium, such as a sheet.

For example, an image forming apparatus is configured to form a sliding guiding member and a positioning member of an attachable/detachable fixing unit or the like on both identical side plates fixed to an apparatus main body.

Also, for example, an image forming apparatus includes a fixing device which is attachable to or detachable from an image forming apparatus main body. The fixing device has an engaging part, which is compatible with positioning with a fixing device supporting member of the image forming apparatus main body, on a side plate of the fixing device. The engaging part has an upward projection which engages with the fixing device supporting member at a proximal part, and the fixing device supporting member has an elastic member which biases the fixing device upward.

SUMMARY

In accordance with an embodiment of the present disclosure, an image forming apparatus includes a fixing unit and an apparatus main body. The fixing unit fixes a toner image on a recording medium. To the apparatus main body, the fixing unit is attached. The apparatus main body includes a holding part which has an opening and an elastically deformable contact part. The opening is arranged at an attachment position of the fixing unit. The contact part protrudes from an edge of the opening to an attachment direction of the fixing unit and is bent so as to narrow the opening. The fixing unit includes a held part protruding at a position corresponding to the holding part, and the held part enters the opening while pressing the contact part so that the held part fits into the opening.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
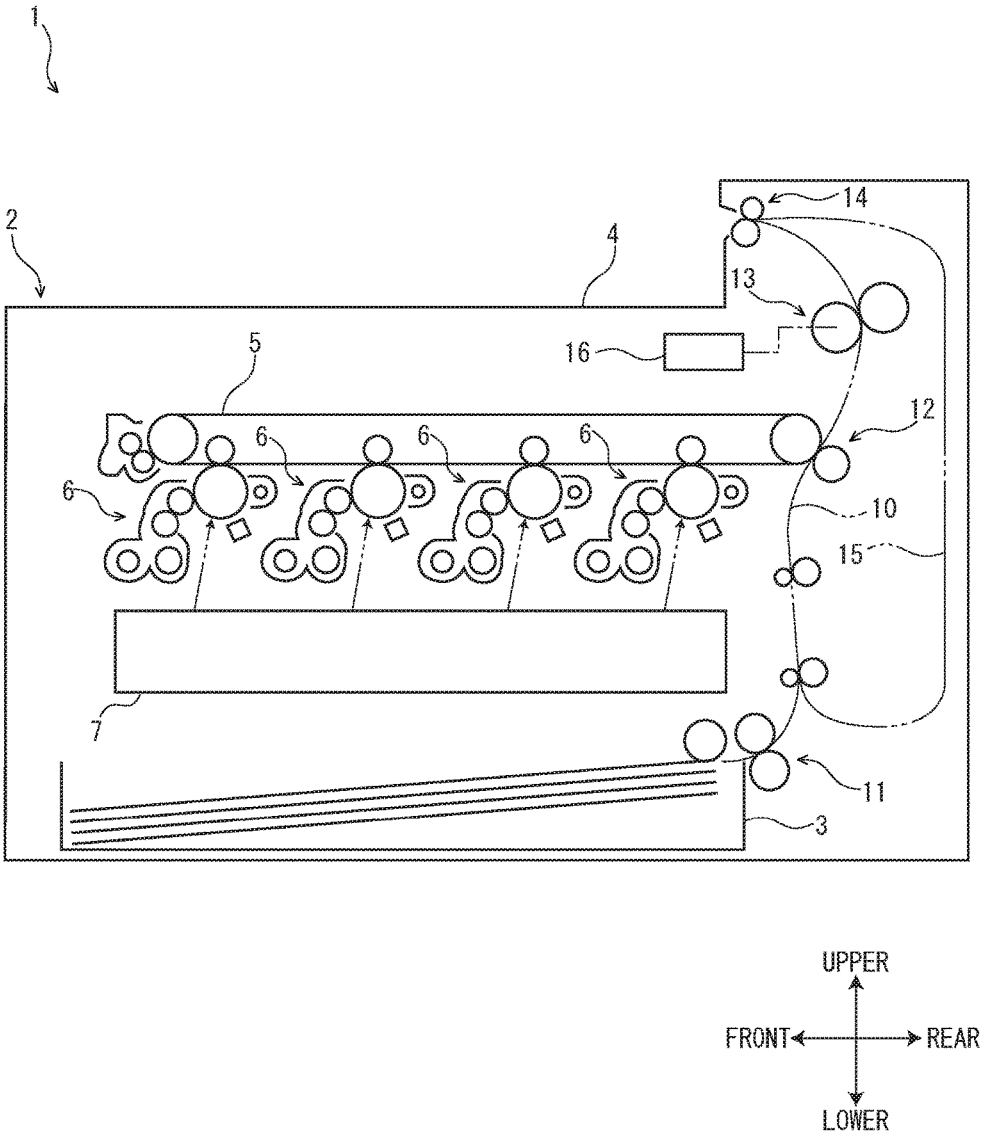
FIG. 1 is a schematic view showing a color printer according to an embodiment of the present disclosure.

With reference to drawings, a color printer 1 (image forming apparatus) according to an embodiment of the present disclosure will be described. FIG. 1 is a schematic view showing a color printer 1. For convenience, a left side of FIG. 1 is defined as a front side of the color printer 1 in the following descriptions.

As shown in FIG. 1, the color printer 1 includes a roughly box-formed printer main body 2 (apparatus main body). In a lower part of the printer main body 2, a sheet feeding cartridge 3 storing a sheet (recording medium) is arranged. In an upper part of the printer main body 2, an ejected sheet tray 4 is arranged.

In a middle part of the printer main body 2, an intermediate transfer belt 5 is arranged around a plurality of rollers. Along a lower face side of the intermediate transfer belt 5, four image forming parts 6 are arranged for respective colors (e.g. four colors of cyan, magenta, yellow, and black) of a toner. Each image forming part 6 includes a rotatable photosensitive drum. Around the photosensitive drum, a charger, a development device, a primary transfer part, a cleaning part, and a static eliminator are located in order of a primary transfer process. Below the four image forming parts 6, an exposure device 7 is arranged.

In a right side part of the printer main body 2, a conveying path 10 for the sheet is arranged in an up-and-down direction. At an upstream end of the conveying path 10, a sheet feeding part 11 is arranged. At a middle stream part of the conveying path 10, a secondary transfer part 12 is arranged at a right end side of the intermediate transfer belt 5. At a downstream part of the conveying path 10, a fixing unit 13 is arranged. At a downstream end of the conveying path 10, a sheet ejection part 14 is arranged. At a right side of the conveying path 10, an inversion path 15 for a duplex printing is arranged.

Incidentally, in the printer main body 2, a driving device 16, which inputs rotation drive force to the fixing unit 13 and other parts, is arranged. The driving device 16 includes a driving source (not shown), such as a motor, and a driving gear 17 (refer to FIG. 16), for example. The driving gear 17 is rotatably supported in the printer main body 2. The driving gear 17 rotates by the rotation drive force generated by activating the driving source, and inputs the rotation drive force to an input gear 37 (refer to FIGS. 13 and 16 or the like) of the fixing unit 13.

Next, image forming operation of the color printer 1 will be described. Firstly, in each image forming part 6, the photosensitive drum is electrically charged by the charger. Then, the exposure device 7 carries out an exposure based on image data, thereby forming an electrostatic latent image on the photosensitive drum. The electrostatic latent image on the photosensitive drum is developed to a toner image of each color by the development device. The toner image is primarily transferred on a surface of the intermediate transfer belt 5 by the primary transfer part. The above-mentioned operation is carried out at the four image forming parts 6, and then the toner image of a full color is formed on the intermediate transfer belt 5. The toner image is supplied to the secondary transfer part 12 on a predetermined timing, by rotation of the intermediate transfer belt 5.

On the other hand, the sheet stored in the sheet feeding cartridge 3 is picked up by the sheet feeding part 11 and conveyed on the conveying path 10. The sheet on the conveying path 10 is conveyed to the secondary transfer part 12 on the predetermined timing. In the secondary transfer part 12, the toner image on the intermediate transfer belt 5 is secondarily transferred on the sheet. The sheet with the secondarily transferred toner image is conveyed to the fixing unit 13 on the conveying path 10, and then, the toner image is fixed on the sheet by the fixing unit 13. Then, the sheet with the fixed toner image is ejected from the sheet ejection part 14 to the ejected sheet tray 4.

Figure 2:
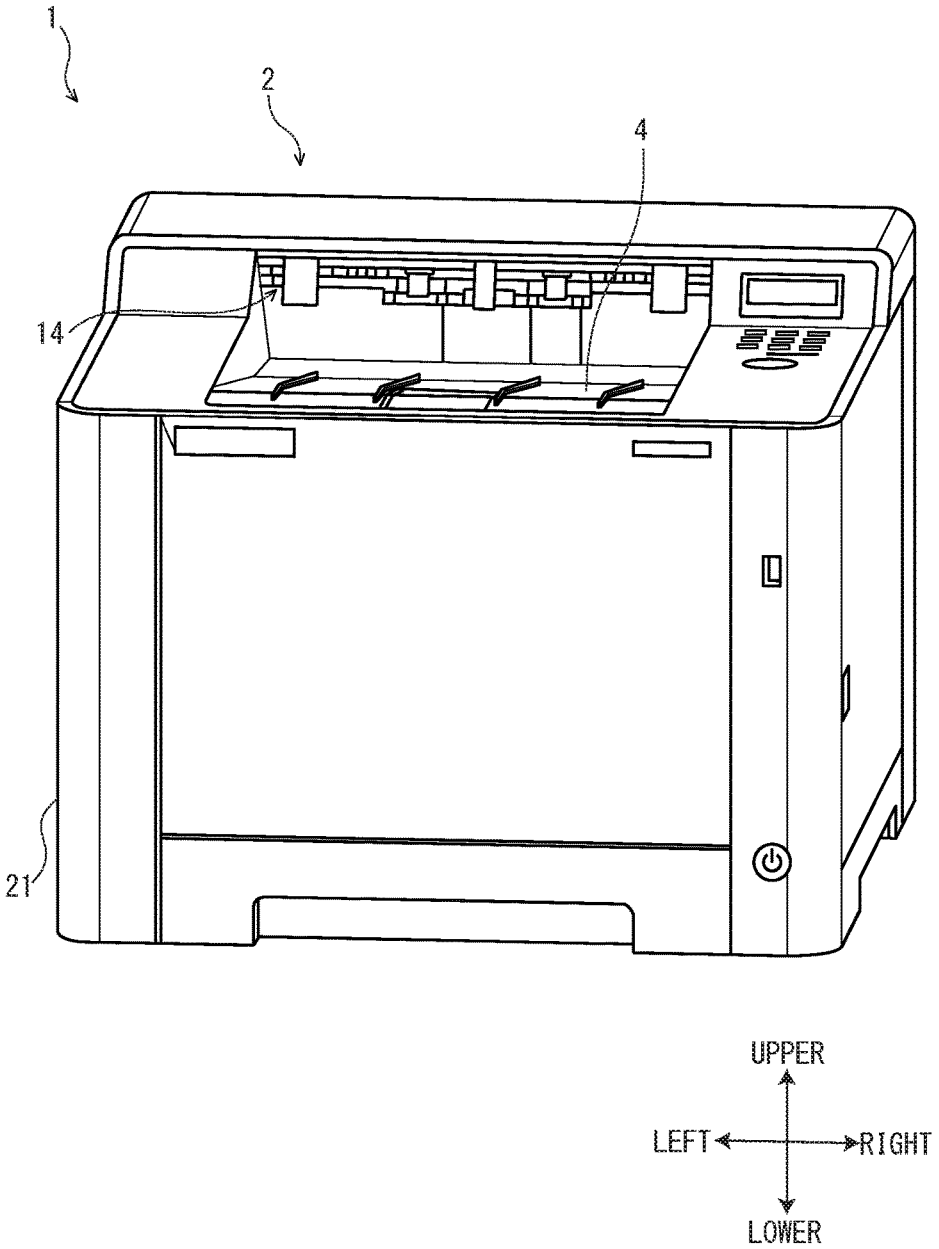
FIG. 2 is a perspective view seen from a front side and showing the color printer according to the embodiment of the present disclosure.
Figure 3:
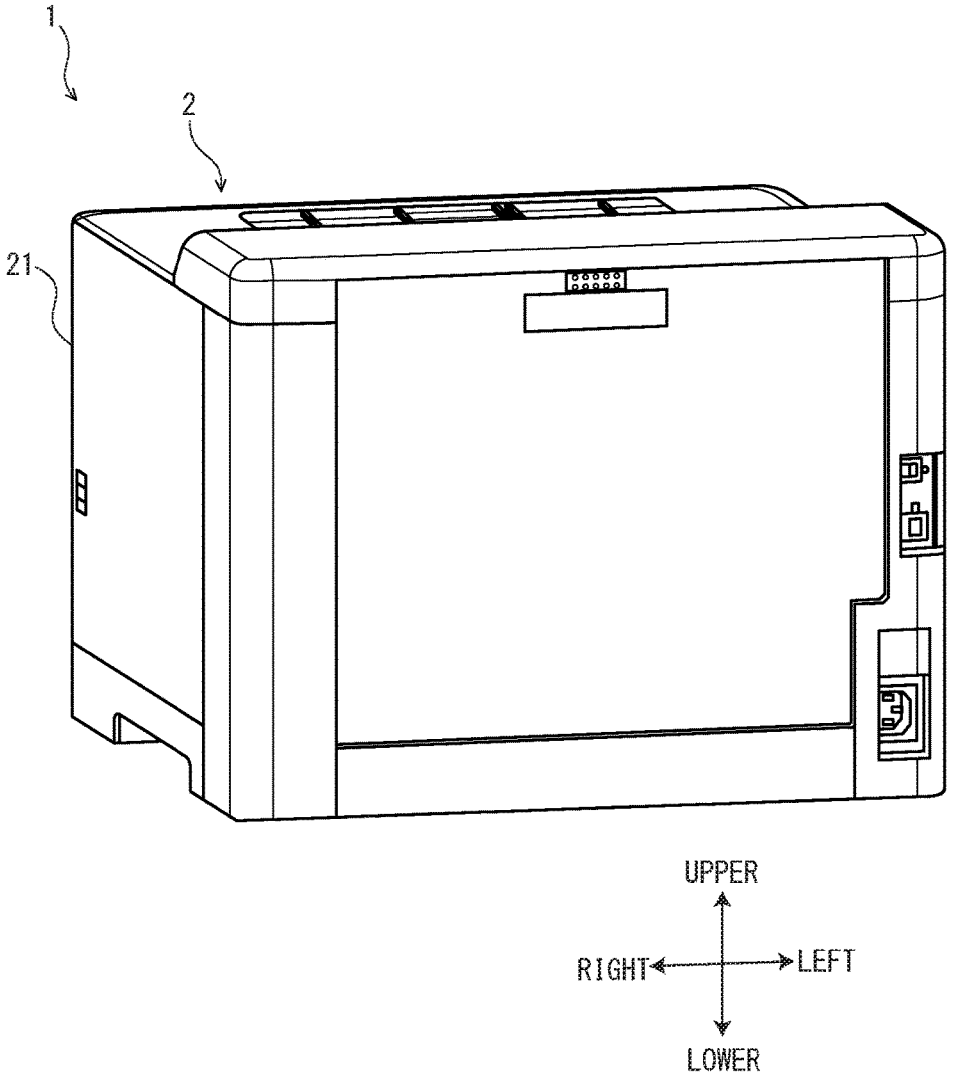
FIG. 3 is a perspective view seen from a rear side and showing the color printer according to the embodiment of the present disclosure.

Next, the printer main body 2 will be further described. The printer main body 2 is composed of a main body frame 20 (refer to FIG. 4 to FIG. 7) and an exterior cover 21 which covers the main body frame 20 (refer to FIG. 2 and FIG. 3). The main body frame 20, as shown in FIG. 4 to FIG. 7, includes a bottom plate 22, a main body left side plate 23, a main body right side plate 24, and a holding frame 25, and is configured to erect the main body left side plate 23 and the main body right side plate 24 upward from both ends in a left-and-right direction of the bottom plate 22.

Figure 4:
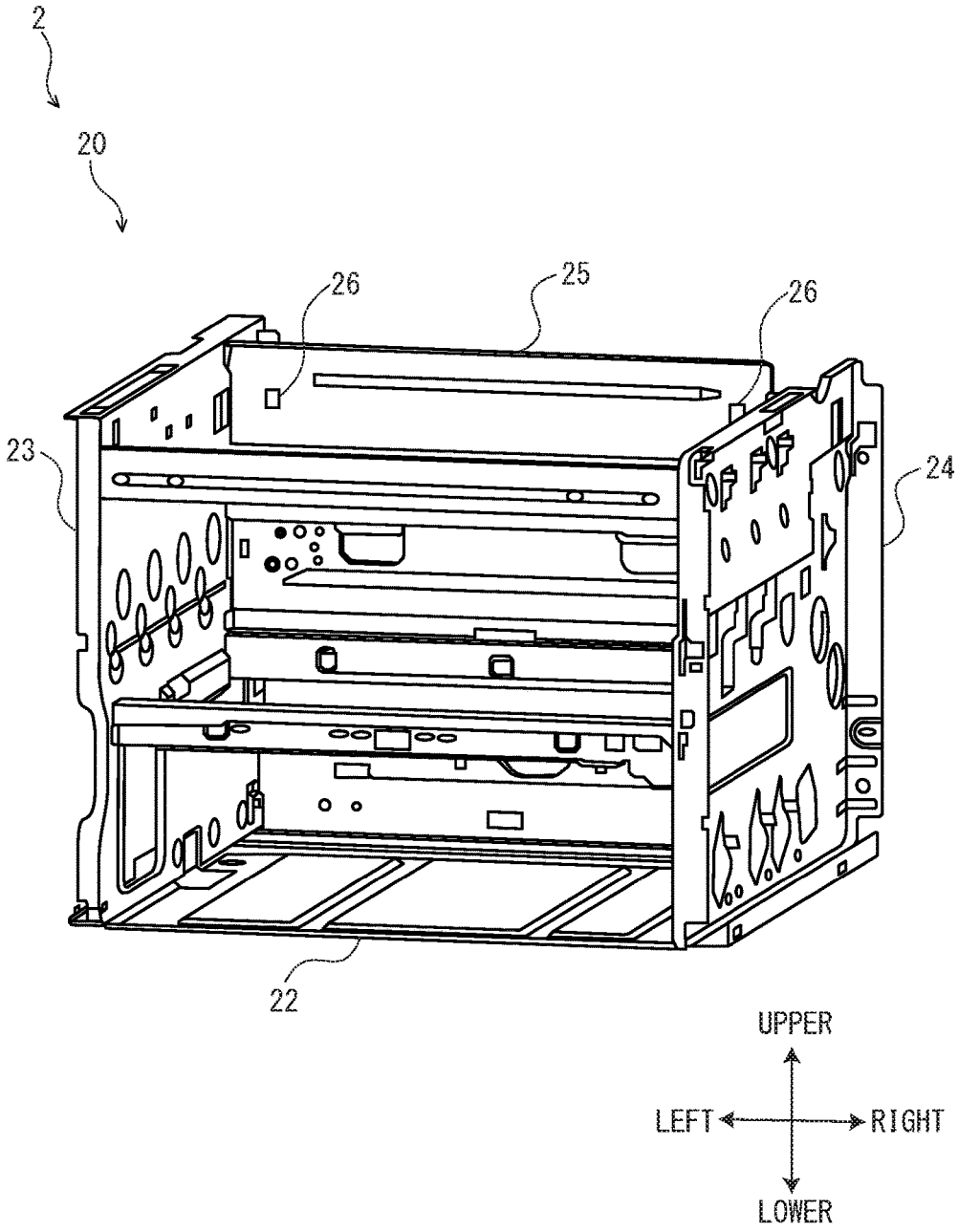
FIG. 4 is a perspective view seen from a front side and showing a main body frame, in the color printer according to the embodiment of the present disclosure.
Figure 5:
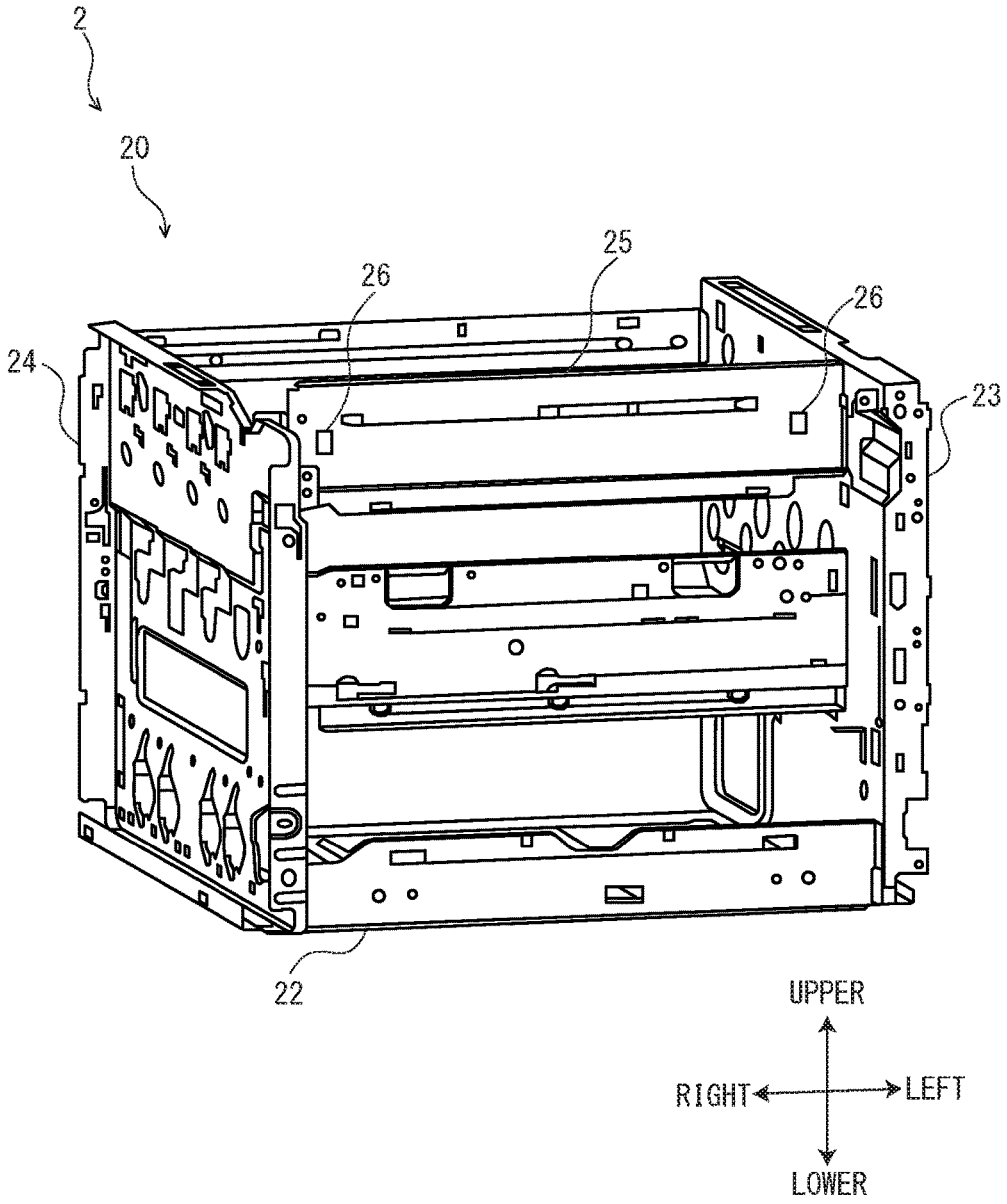
FIG. 5 is a perspective view seen from a rear side and showing the main body frame, in the color printer according to the embodiment of the present disclosure.
Figure 6:
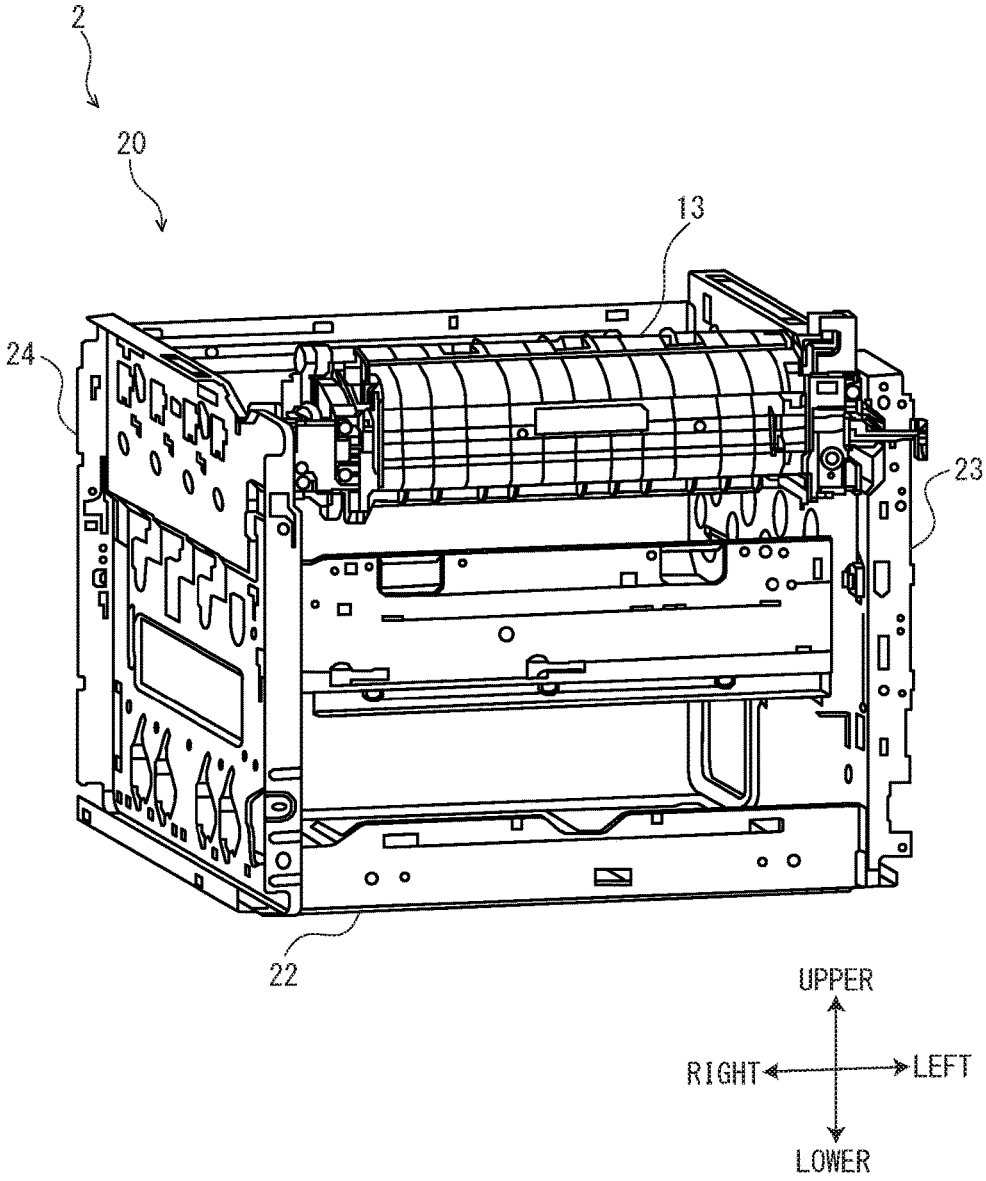
FIG. 6 is a perspective view seen from a rear side and showing the main body frame to which a fixing unit is attached, in the color printer according to the embodiment of the present disclosure.
Figure 7:
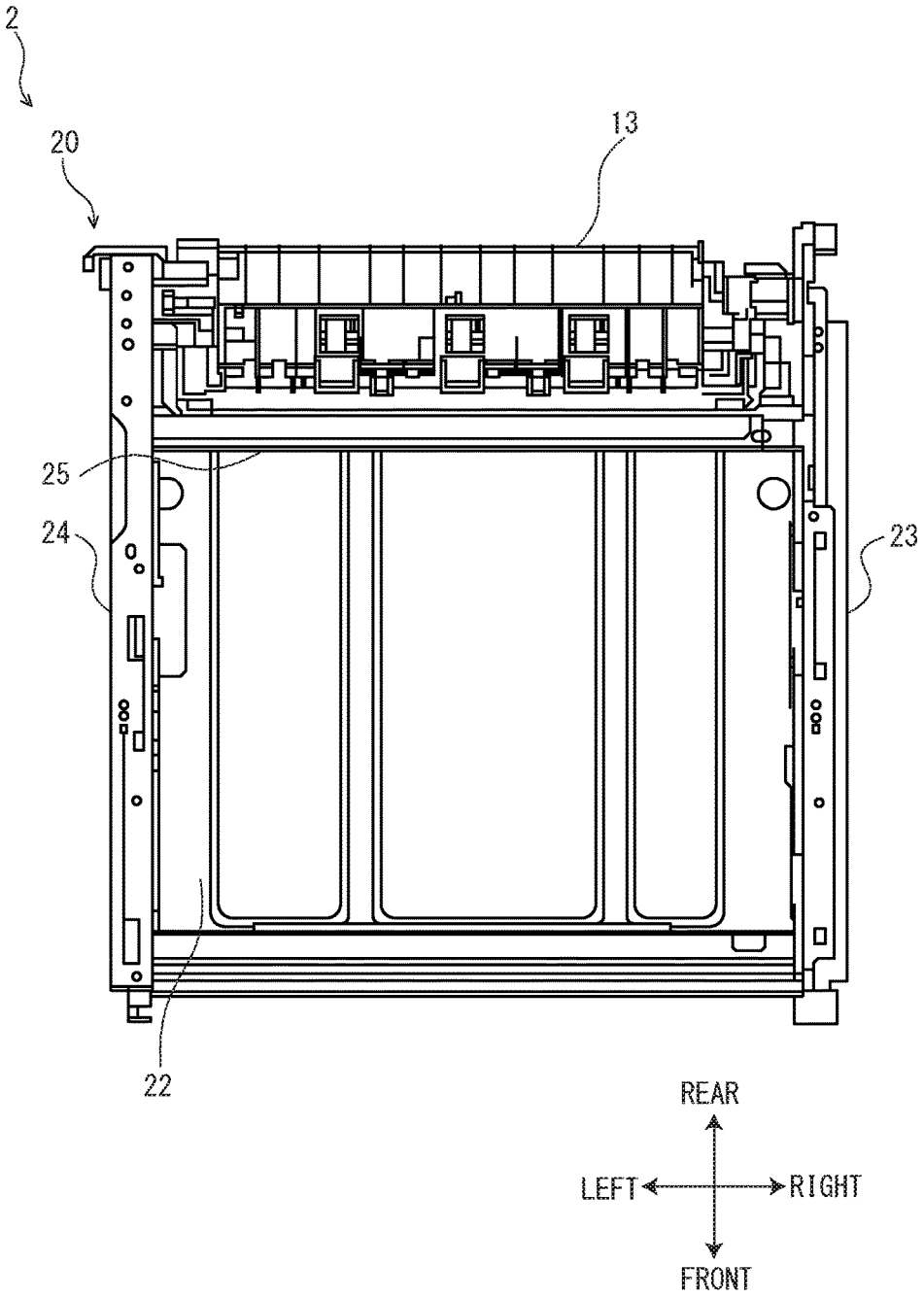
FIG. 7 is a top view showing the main body frame to which the fixing unit is attached, in the color printer according to the embodiment of the present disclosure.
Figure 8:
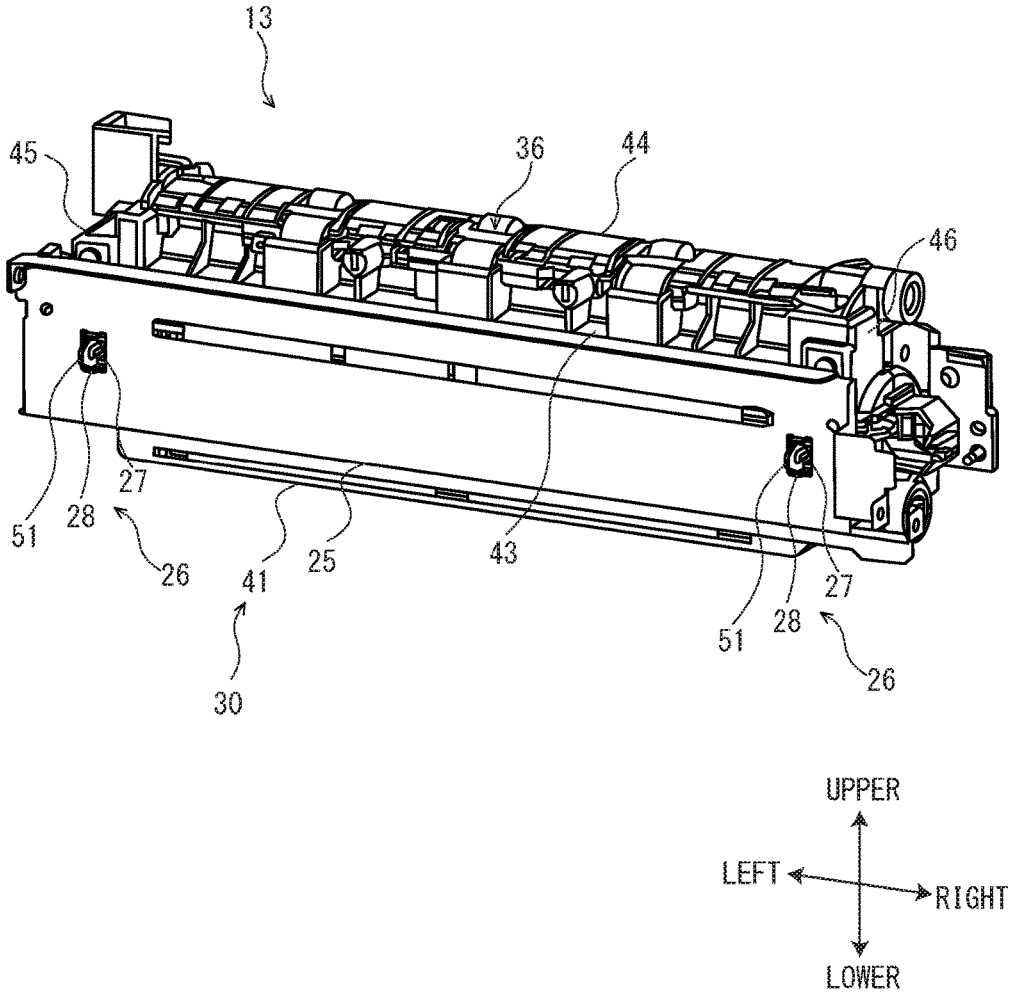
FIG. 8 is a perspective view seen from a rear side and showing a holding frame of the main body frame and the fixing unit, in the color printer according to the embodiment of the present disclosure.
Figure 9:
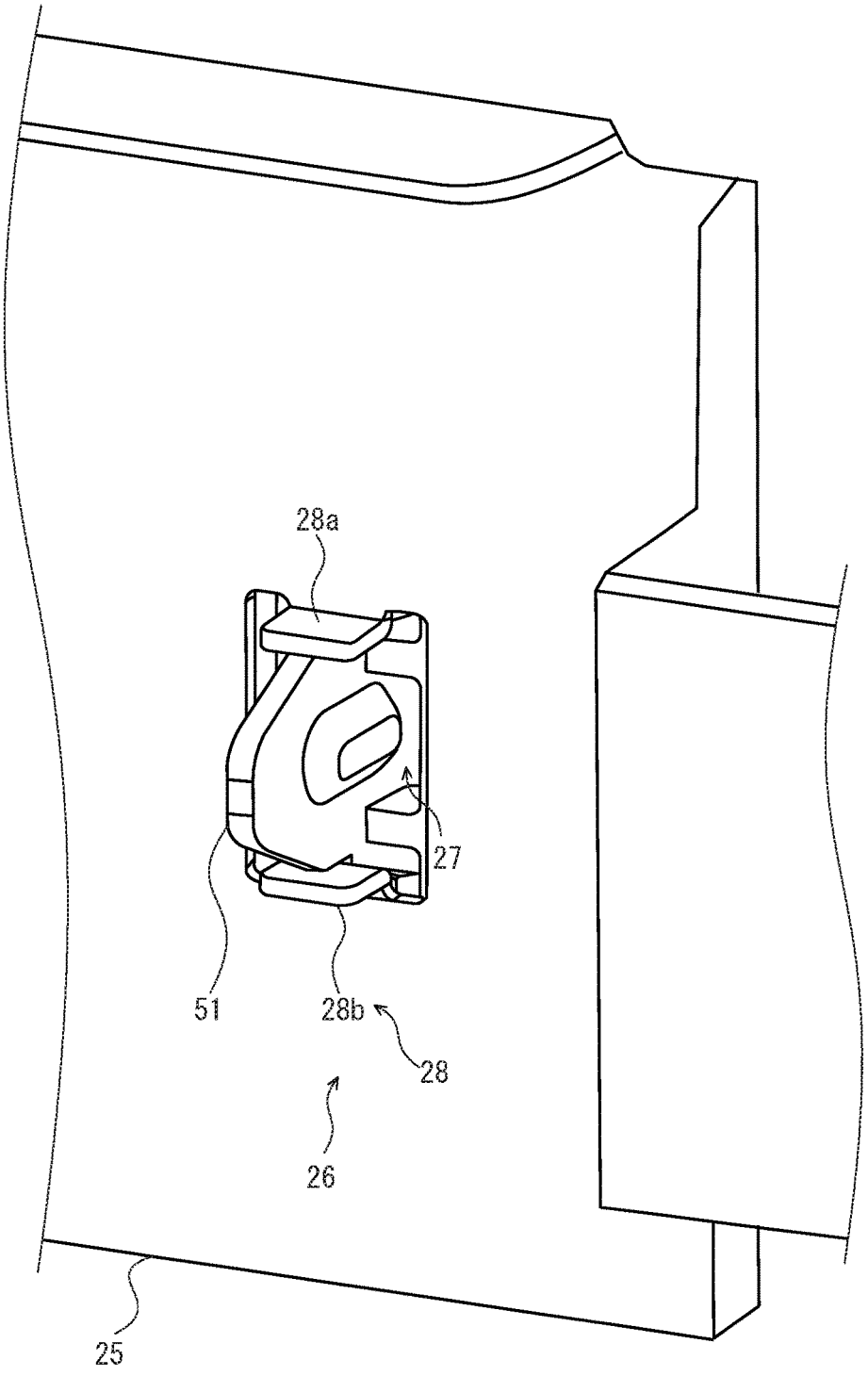
FIG. 9 is an enlarged perspective view showing the holding frame of the main body frame and the fixing unit, in the color printer according to the embodiment of the present disclosure.
Figure 10:
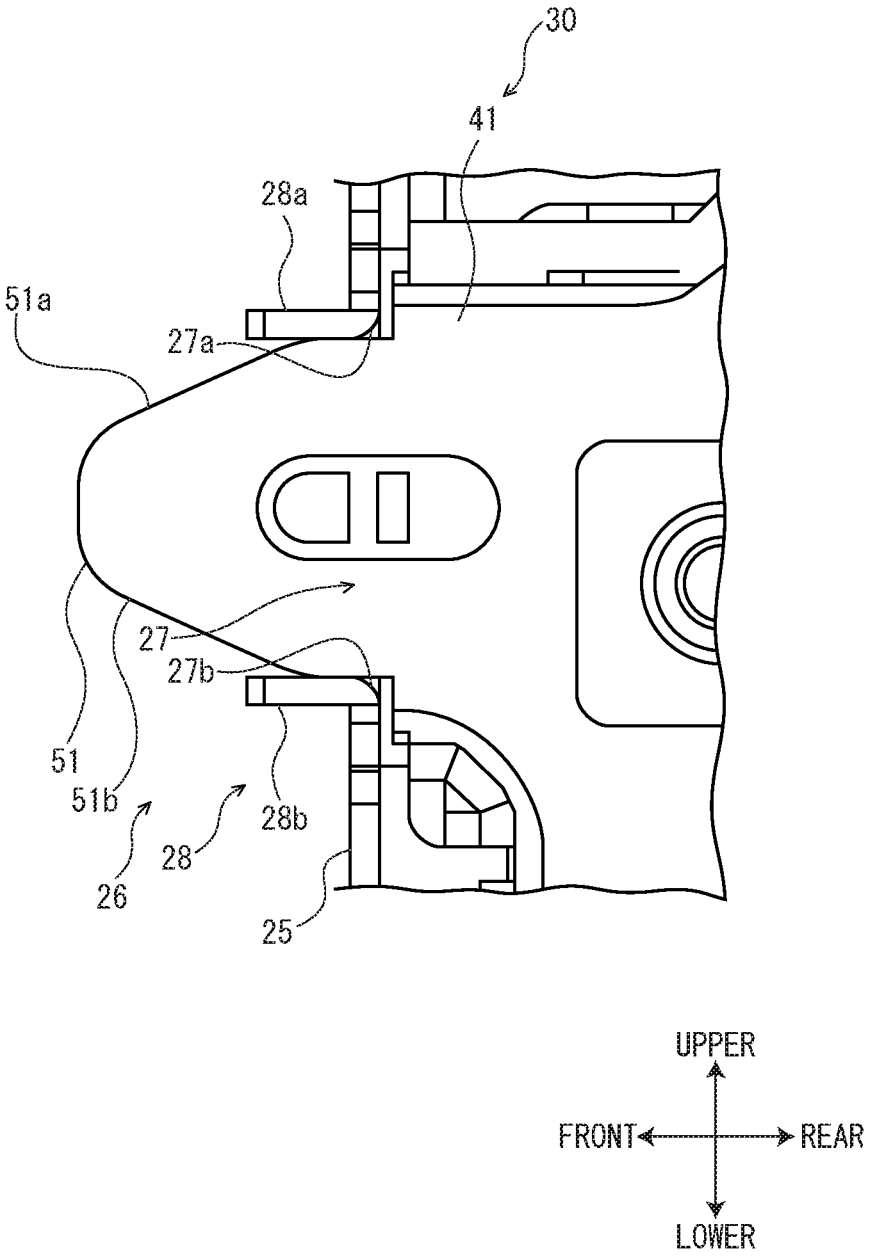
FIG. 10 is an enlarged view showing the holding frame of the main body frame after the fixing unit is attached thereto, in the color printer according to the embodiment of the present disclosure.

The holding frame 25, as shown in FIG. 4, FIG. 5, and FIG. 7, at a rear side, has a mounting face on which a fixing unit 13 is to be mounted, and is formed of a substantially flat metal plate which is elongated in the left-and-right direction. The holding frame 25, at a rear top of the main body frame 20, is hanged between the main body left side plate 23 and the main body right side plate 24 at predetermined intervals from a rear end of the main body frame 20 (as shown in FIG. 6 and FIG. 7, a predetermined space in which the fixing unit 13 can be disposed). The holding frame 25 includes one or more holding parts 26 for holding the fixing unit 13, and as shown in FIG. 8 to FIG. 11, for example, includes two holding parts 26 at their appropriate positions of both ends in the left-and-right direction at a center in a vertical direction, as an attachment position of the fixing unit 13.

Figure 11:
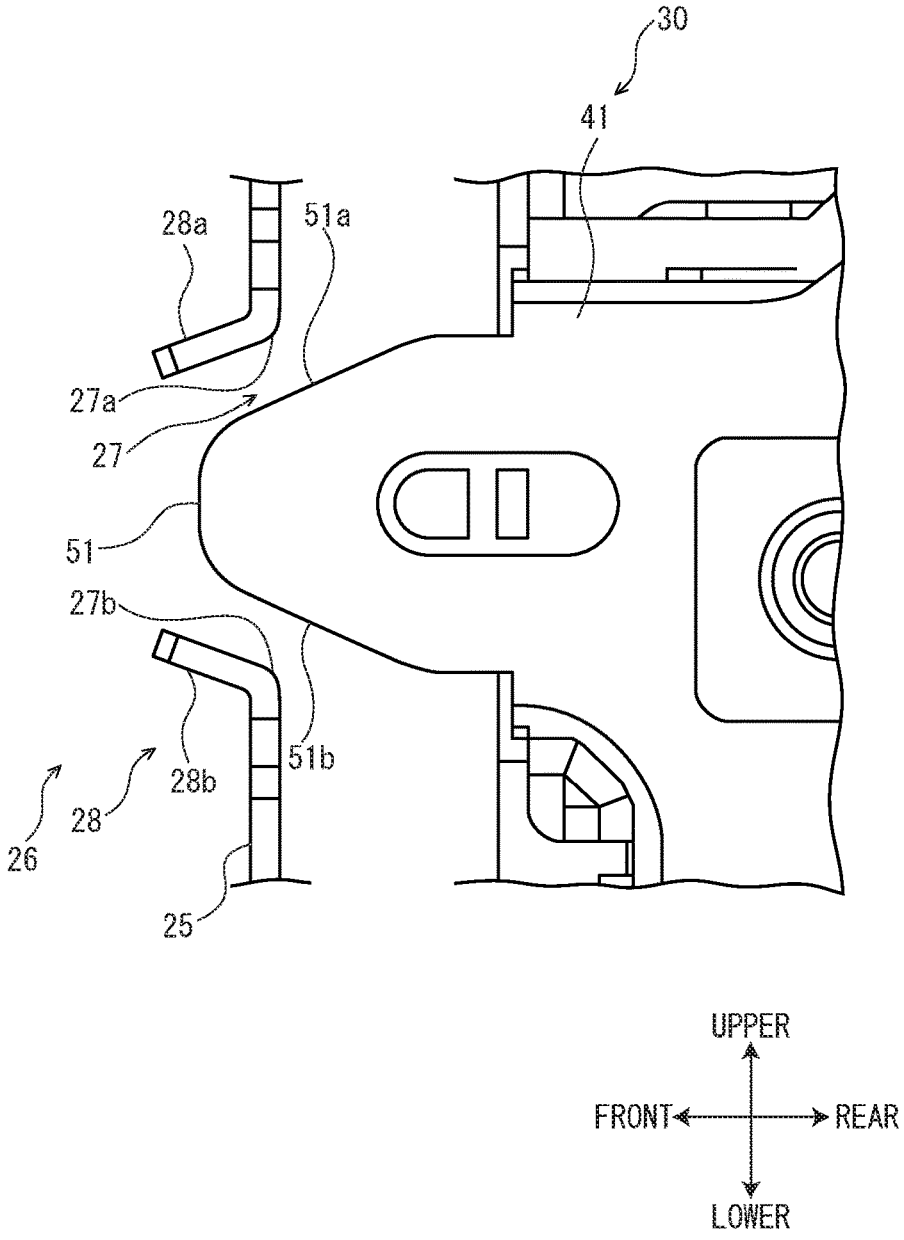
FIG. 11 is an enlarged view showing the holding frame of the main body frame before the fixing unit is attached thereto, in the color printer according to the embodiment of the present disclosure.

Each holding part 26 has an opening 27 which is formed to penetrate in a front-and-rear direction and an elastically deformable contact parts 28 which are arranged to protrude from edges of the opening 27 to an attachment direction (front side) of the fixing unit 13. The opening 27 is formed in dimensions that a held part 51 of the fixing unit 13, which will be described later, can fit into the opening 27. The contact parts 28 are formed integrally with the holding frame 25, and as shown in FIG. 11, are formed in a plate spring shape bent so as to narrow the opening 27. For example, the contact parts 28 include an upper contact part 28*a* provided at an upper edge 27*a* of the opening 27 and a lower contact part 28*b* provided at a lower edge 27*b* of the opening 27. The upper contact part 28*a* is arranged to protrude in an obliquely downward direction from the upper edge 27*a* of the opening 27 towards the attachment direction (front side), and is formed to be bent so as to narrow the opening 27 from an upper side. The lower contact part 28*b* is arranged to protrude in an obliquely upward direction from the lower edge 27*b* of the opening 27 towards the attachment direction (front side), and is formed to be bent so as to narrow the opening 27 from a lower side.

Figure 12:
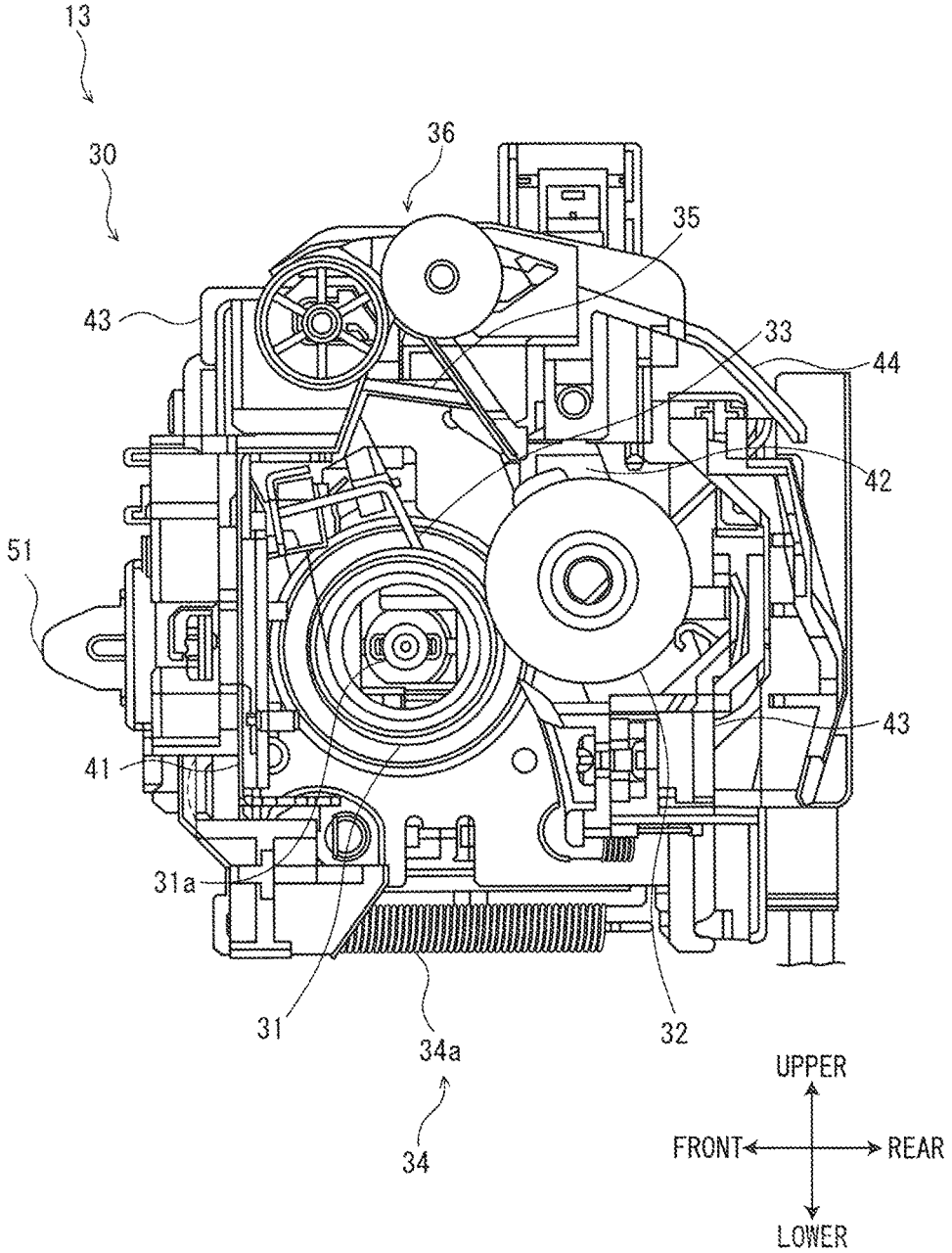
FIG. 12 is an overall view showing the fixing unit, in the color printer according to the embodiment of the present disclosure.

Next, the fixing unit 13 will be further described. The fixing unit 13 is attachable to or detachable from the printer main body 2, and in particular, as shown in FIG. 6 and FIG. 7, is configured to be attached to or detached from the holding frame 25 of the main body frame 20. The fixing unit 13 has an elongated shape in the left-and-right direction, and as shown in FIG. 12, includes a fixing frame 30, a heating member 31, a pressing member 32, a separating plate 33, a pressing mechanism 34, a sheet sensing unit 35, a pair of ejecting rollers 36, and an input gear 37 (refer to FIG. 13 and FIG. 16).

Figure 13:
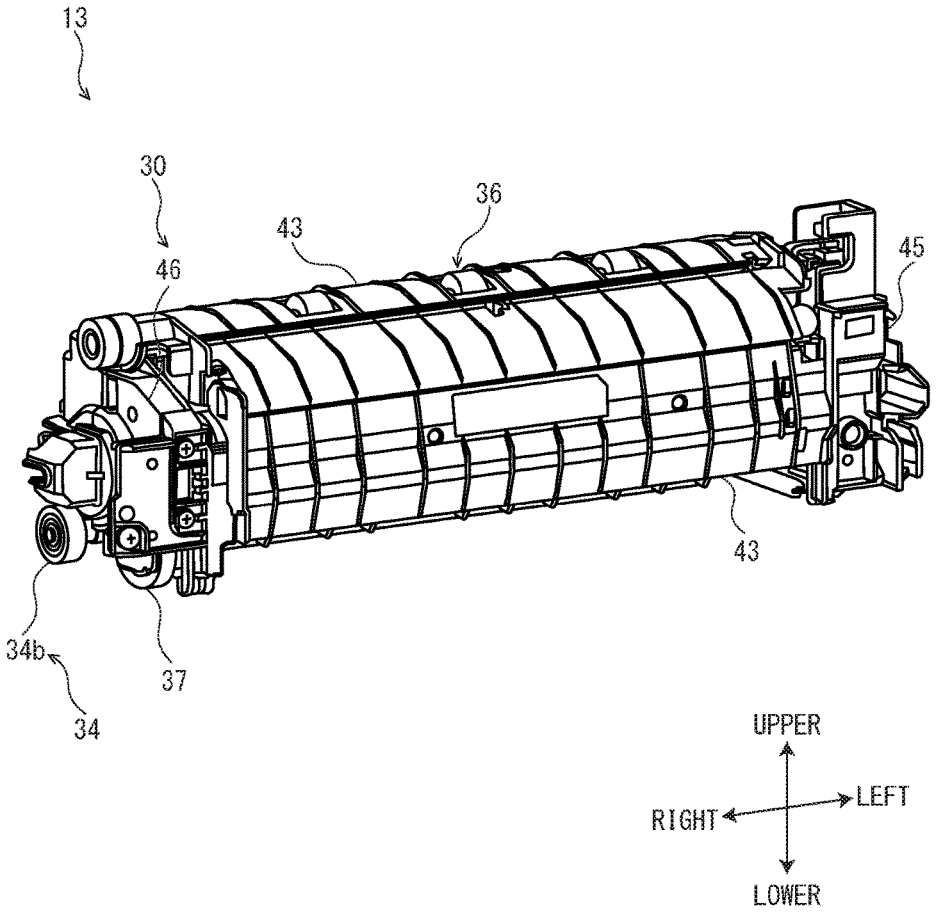
FIG. 13 is a perspective view seen from a rear side and showing the fixing unit, in the color printer according to the embodiment of the present disclosure.

The fixing frame 30 is formed in a hollow substantially boxed shape, and is configured to have, on a bottom face, an opening to introduce a sheet to be fixed, and to have, on a top face, an opening to eject the sheet after fixed so that the conveying path 10 passes through the fixing frame 30 in the vertical direction. The fixing frame 30 includes a first frame 41 for mounting the heating member 31 and a second frame 42 for mounting the pressing member 32. In the fixing frame 30, the first frame 41 is provided at an attachment direction side(front side) of the fixing unit 13, and the second frame 42 is provided at a detachment direction side(rear side) of the fixing unit 13. In addition, the fixing frame 30 includes a first cover 43 which covers the first frame 41 from the attachment direction side(front side) of the fixing unit 13 and a second cover 44 which covers the second frame 42 from the detachment direction side (rear side) of the fixing unit 13. Further, the fixing frame 30, as shown in FIG. 13, includes a left side cover 45 which covers the first frame 41 from a left side and a right side cover 46 which covers the first frame 41 from a right side.

Figure 14:
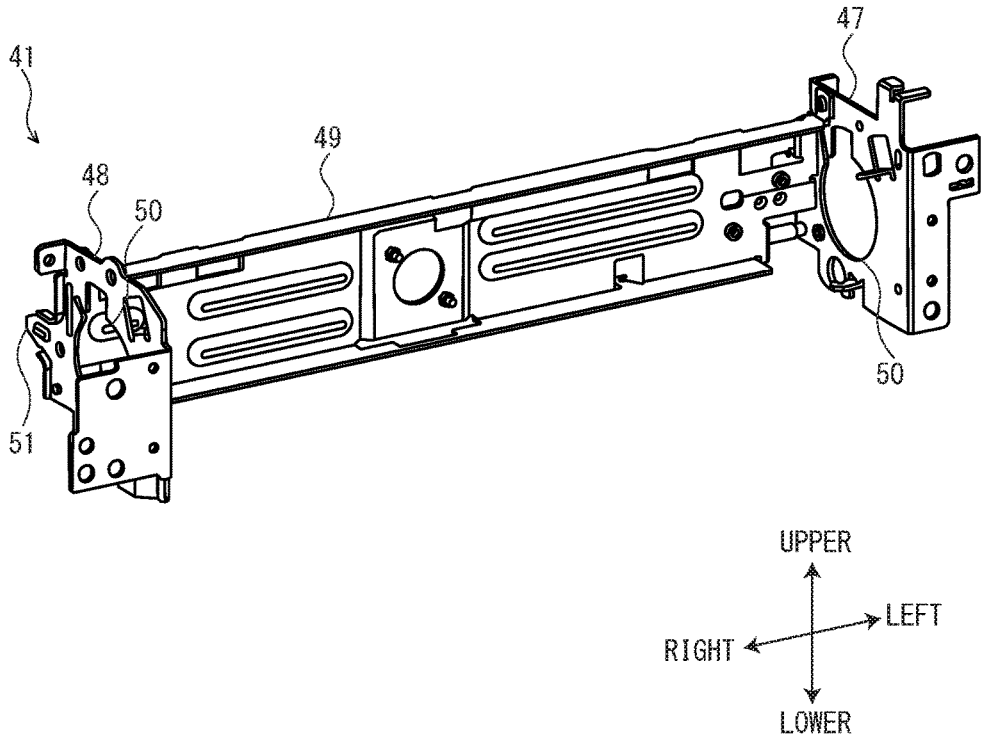
FIG. 14 is a perspective view seen from a rear side and showing a first frame of the fixing unit, in the color printer according to the embodiment of the present disclosure.
Figure 15:
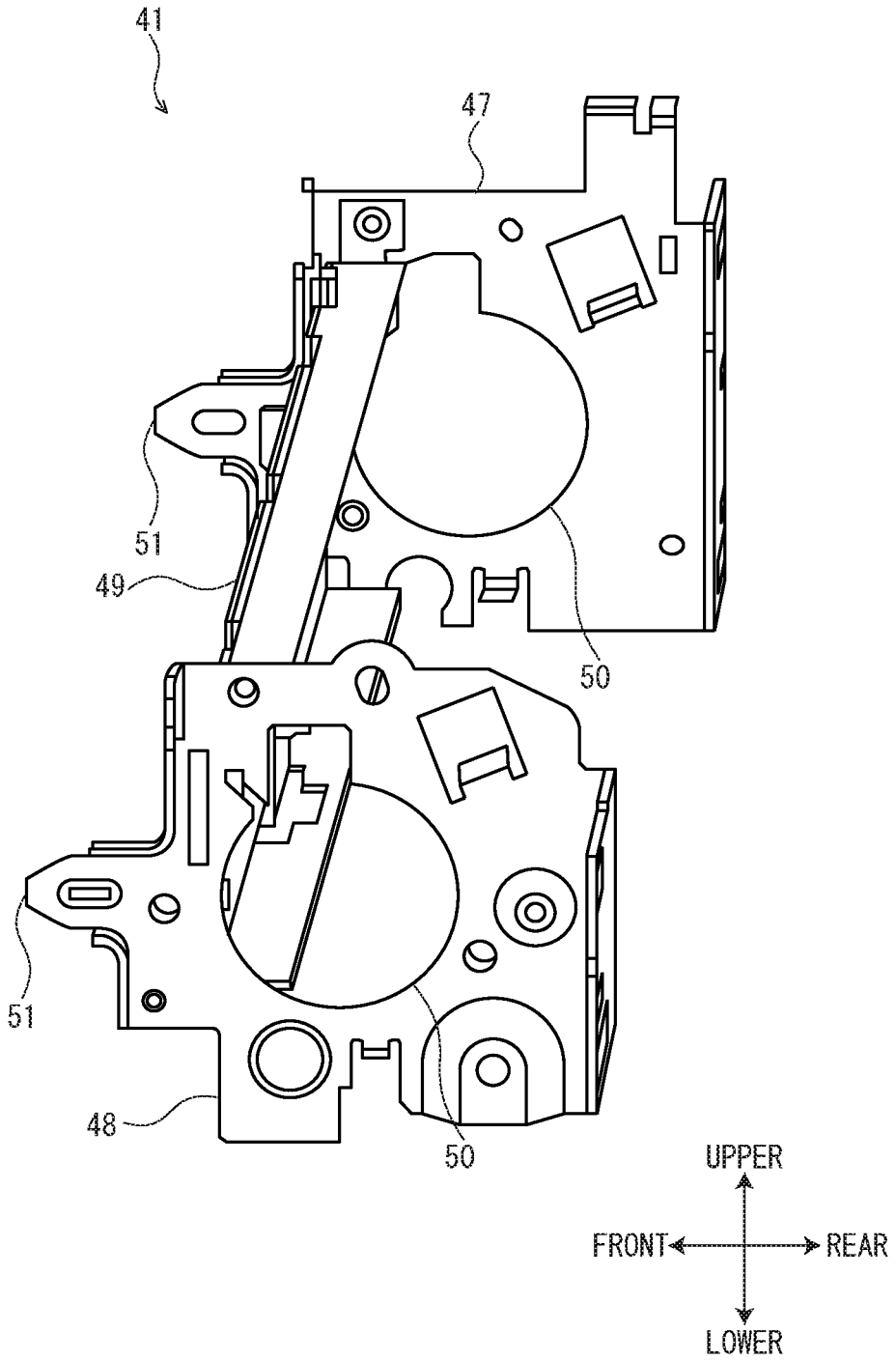
FIG. 15 is a perspective view seen from a right side and showing the first frame of the fixing unit, in the color printer according to the embodiment of the present disclosure.

The first frame 41 has an elongated shape in the left-and-right direction, as shown in FIG. 14 and FIG. 15. The first frame 41 includes a fixing left side plate 47, a fixing right side plate 48, and a front plate 49 and is configured to hang the front plate 49 between the fixing left side plate 47 and the fixing right side plate 48. The fixing left side plate 47 and the fixing right side plate 48 each are formed in a substantially symmetrical shape, and coaxially have a mounting hole 50 for mounting the heating member 31. In addition, the fixing left side plate 47 and the fixing right side plate 48 each include a held part 51 protruding in the attachment direction (front side) of the fixing unit 13. Even in a state where the first frame 41 is covered with the first cover 43, the held part 51 protrudes more outward than the first cover 43.

The held part 51, in a state where the fixing unit 13 is attached to the holding frame 25, is provided at a position which corresponds to each holding part 26 of the holding frame 25. The held part 51 is formed in a shape which is capable of fitting into the opening 27 of each holding part 26. When the fixing unit 13 is attached to the holding frame 25, the held part 51 presses the contact parts 28 of each holding part 26 while coming into contact therewith. For example, the held part 51 enters the opening 27 while respectively pressing the upper contact part 28*a* and the lower contact part 28*b* upward and downward, and fits into the opening 27. An upper face 51*a* of a distal end of the held part 51 is arranged to extend to a front side (attachment direction) so as to incline downward. A lower face 51*b* of the distal end of the held part 51 is arranged to extend to the front side (attachment direction) so as to incline upward.

The held part 51 is formed in a platy shape arranged to extend so as to come into contact with the contact parts 28 (upper contact part 28*a* and lower contact part 28*b*) to be thereby able to enhance rigidity with respect to the contact parts 28 and able to avoid deformation or damaging or the like brought about by counterforce of the contact parts 28. In addition, in the held part 51, the upper face and the lower face of the distal end (front end) each are formed in a tapered shape to be thereby able to easily press the upper contact part 28*a* and the lower contact part 28*b*.

The front plate 49 has, at a front part, an opposing face which opposes to amounting face of the holding frame 25. The front plate 49 is formed in a substantially flat metal plate which is elongated in the left-and-right direction.

The heating member 31 is formed in a columnar shape which is elongated in the front-and-rear direction, and is a heating roller which is supported to be rotatable via a bearing (not shown) by the mounting holes 50 of the fixing left side plate 47 and the fixing right side plate 48, in the first frame 41 of the fixing frame 30. A rotation axis direction of the heating member 31 is the left-and-right direction, and at a right end of a rotating shaft of the heating member 31, a transmission gear (not shown) for transmitting rotation drive force to the heating member 31 is provided. The heating member 31 internally includes a heat source 31*a* such as a halogen heater or a ceramics heater, for example (refer to FIG. 12), and a surface of the heating member 31 is heated by the heat source 31*a*.

The pressing member 32 is formed in a columnar shape which is elongated in the front-and-rear direction, and is a pressing roller which is supported to be rotatable via a bearing (not shown), in the second frame 42 of the fixing frame 30. The pressing member 32 is brought into pressure contact with an outer circumferential face of the heating member 31, and a fixing nip N is thereby formed between the heating member 31 and the pressing member 32. A rotation axis direction of the pressing member 32 is the left-and-right direction and the pressing member 32 slides and rotates according to rotation of the heating member 31.

The separating plate 33 is provided at an upper side of the heating member 31, and separates a sheet from the heating member 31, after the sheet have passed through the fixing nip N between the heating member 31 and the pressing member 32 and fixing processing has been applied to the sheet.

The pressing mechanism 34 is a mechanism for bringing the pressing member 32 into pressure contact with the heating member 31. The pressing mechanism 34 includes a pressing spring 34*a* coupled between the first frame 41 in which the heating member 31 is provided and the second frame 42 in which the pressing member 32 is provided, and the second frame 42 is biased to the first frame 41 side by biasing force of the pressing spring 34*a* to thereby bring the pressing member 32 into pressure contact with the heating member 31. In addition, the pressing mechanism 34 includes a pressurization or depressurization adjusting unit 34*b* to adjust the biasing force of the pressing spring 34*a* (refer to FIG. 13 or the like).

The sheet sensing unit 35 is provided on the conveying path 10 between the fixing nip N and the pair of ejecting rollers 36, and is composed of an actuator or the like to sense the sheet after the fixing processing before the sheet is ejected.

The pair of ejecting rollers 36 are provided at the opening of the top face of the fixing frame 30 to eject the sheet after the fixing processing to the sheet ejection part 14 along the conveying path 10.

Figure 16:
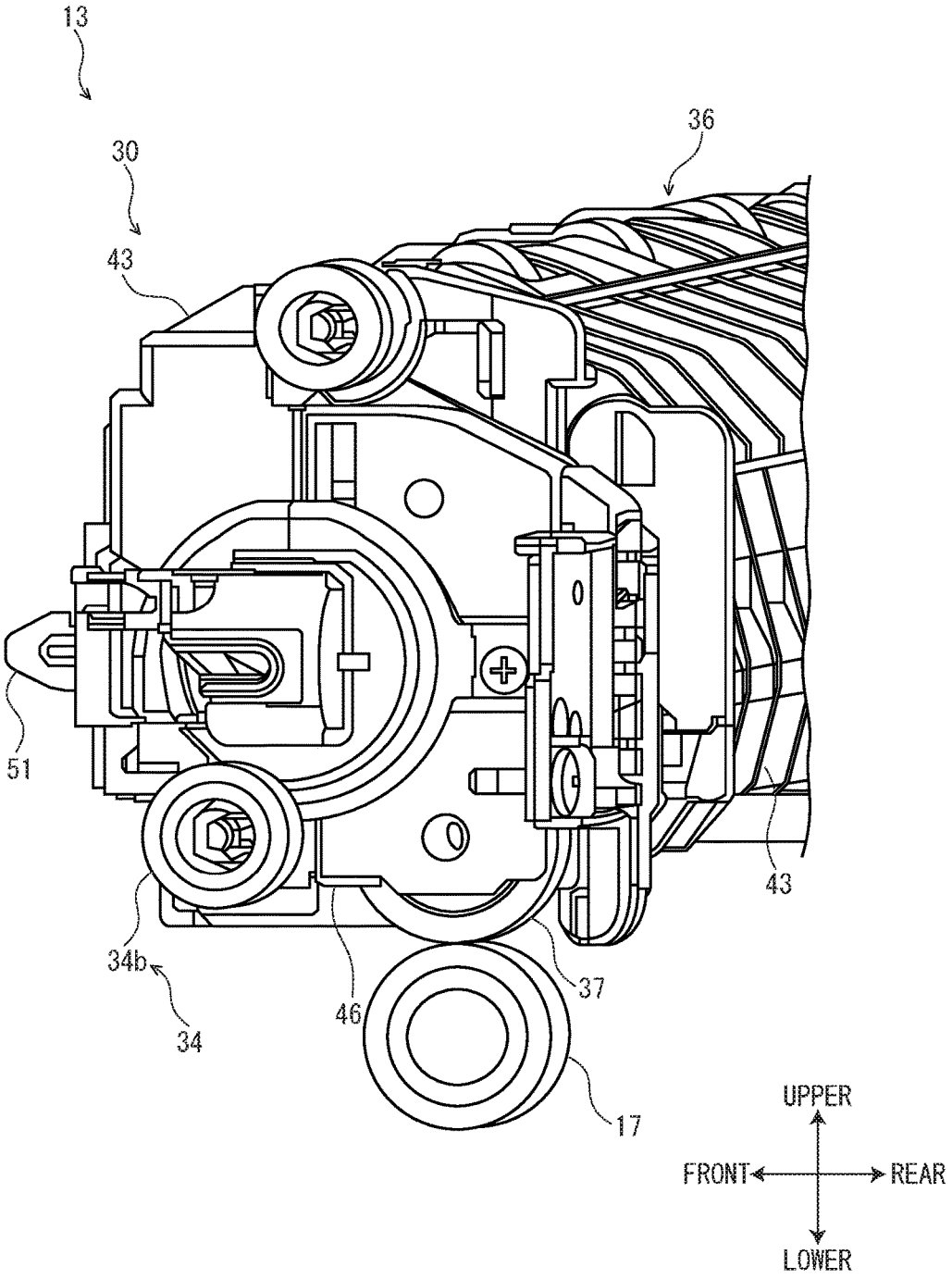
FIG. 16 is a perspective view seen from a right side and showing the fixing unit, in the color printer according to the embodiment of the present disclosure.
Figure 17:
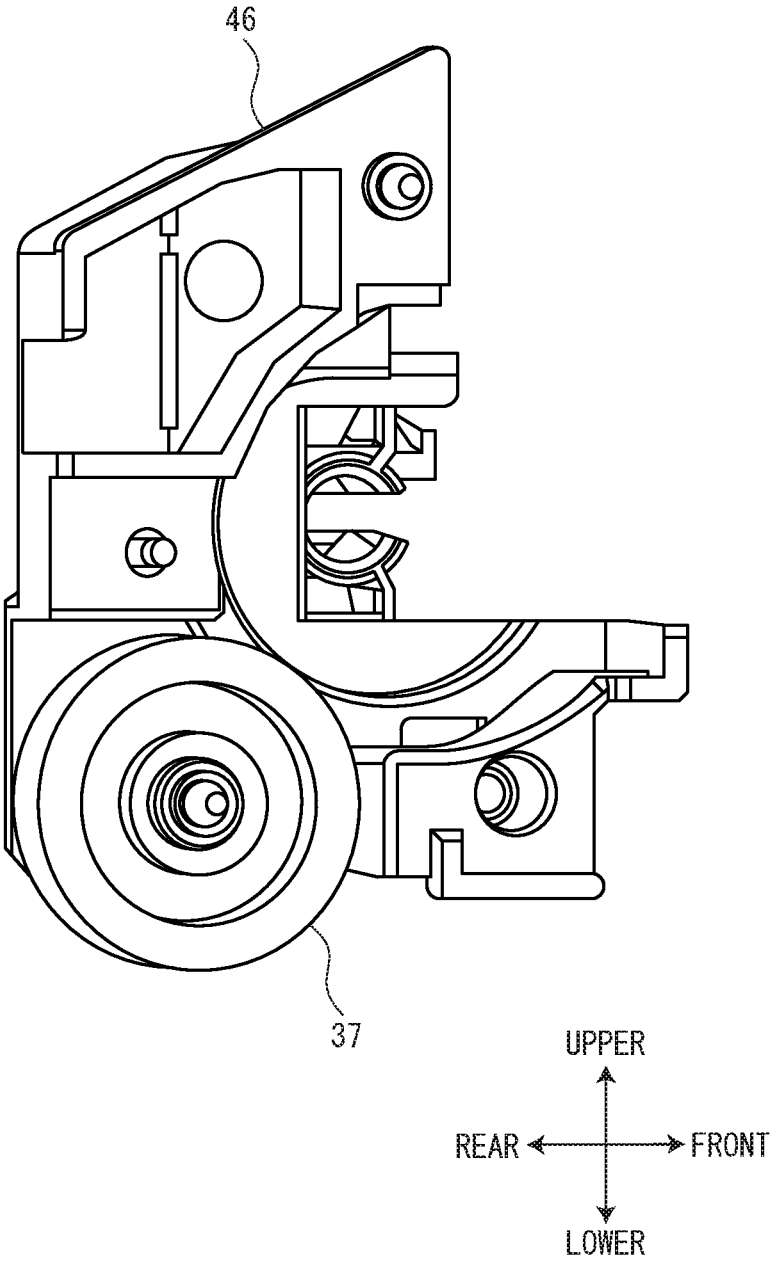
FIG. 17 is a perspective view seen from a left side and showing a right side cover of the fixing unit, in the color printer according to the embodiment of the present disclosure.

The input gear 37, as shown in FIG. 16 and FIG. 17, is rotatable between the first frame 41 and the right side cover 46 of the fixing frame 30, and is arranged at an upper side of the driving gear 17 of the driving device 16 in the printer main body 2. A rotation axis direction of the input gear 37 is the left-and-right direction, and a rotation direction of the input gear 37 is a clockwise direction as seen from a right side. The input gear 37 is connected to a transmission gear (not shown) of the heating member 31 and is connected to the driving gear 17 of the driving device 16. A rotation axis direction of the driving gear 17 is the left-and-right direction, and a rotation direction of the driving gear 17 is a counterclockwise direction as seen from the right side.

That is, a direction A (tangential direction of the driving gear 17 and the input gear 37) in which rotation drive force is input between the driving gear 17 of the driving device 16 and the input gear 37 of the fixing unit 13 is the attachment direction (front side) of the fixing unit 13. Therefore, in the fixing frame 30, the held parts 51 of the fixing left side plate 47 and the fixing right side plate 48 of the first frame 41 are respectively provided so as to protrude towards the tangential direction A at the ends of the driving gear 17 and the input gear 37 in the tangential direction A.

According to the embodiment, as described above, the color printer 1 includes the fixing unit 13 fixing the toner image to the sheet (recording medium) and the printer main body 2 (apparatus main body) to which the fixing unit 13 is attached. The printer main body 2, in the holding frame 25 of the main body frame 20, includes each holding part 26 having the opening 27 which is arranged at the attachment position of the fixing unit 13 and the elastically deformable contact parts 28 protruding from the edge of the opening 27 to the attachment direction of the fixing unit 13 and bent so as to narrow the opening 27. The fixing unit 13 includes the held part 51 protruding at the position corresponding to each holding part 26 in the fixing frame 30 (first frame 41). The held part 51 enters the opening 27 while pressing the contact parts 28 so that the held part 51 fits into the opening 27.

In this manner, vibration produced in the fixing unit 13 can be absorbed and restrained by elasticity (spring property) of each holding part 26 that is an attachment mechanism of the fixing unit 13. Therefore, it is possible to stabilize the fixing process in the fixing unit 13 and restrain an image failure. Hence, there is no need for special elements or parts to restrain vibration of the fixing unit 13 and thus it is possible to reduce costs or weight and to achieve space saving.

Further, according to the embodiment, the printer main body 2 includes the holding frame 25 at which each holding part 26 is arranged, and the fixing unit 13 includes the fixing frame 30 at which the held part 51 is arranged.

In this manner, in the existing color printer 1 or another image forming apparatus as well, the vibration generated in the fixing unit 13 can be restrained merely by changing the holding frame 25 or the fixing frame 30.

Furthermore, according to the embodiment, the held part 51 is formed in a plate shape and extends so as to come into contact with the contact parts 28 of each holding part 26.

In this manner, it is possible to increase the rigidity of the held part 51 with respect to the contact parts 28 of each holding part 26, and it is also possible to avoid deformation or damaging or the like of the held part 51 exerted by the counterforce from the contact parts 28.

Still furthermore, according to the embodiment, the contact parts 28 of each holding part 26 include the upper contact part 28*a* protruding from the upper edge 27*a* of the opening 27 and bent so as to narrow the opening 27 from an upper side and the lower contact part 28*b* protruding from the lower edge 27*b* of the opening 27 and bent so as to narrow the opening 27 from a lower side.

In this manner, it is possible to efficiently restrain the vibration in the vertical direction generated in the fixing unit 13.

Yet furthermore, according to the embodiment, the fixing unit 13 includes the rotatable heating member 31; and the rotatable input gear 37 transmitting the rotation drive force to the heating member 31. The printer main body 2 includes the rotatable driving gear 17 inputting the rotation drive force to the input gear 37. In addition, the fixing unit 13, in the fixing frame 30 (first frame 41), includes the held part 51 protruding in the tangential direction at an end in the tangential direction of the driving gear 17 and the input gear 37.

In this manner, it is possible to efficiently restrain the vibration when the fixing unit 13 inputs the rotation drive force from the driving device 16. In addition, even in a case where force of shifting the fixing unit 13 is effected by the rotation drive force input from the driving device 16, this force acts in the direction in which the fixing unit 13 is attached to the printer main body 2. Therefore, at the time of actuation of the fixing unit 13, the first frame 41 of the fixing unit 13 is pulled up to the holding frame 25 of the printer main body 2, and force acts in the direction in which the held part 51 fits into each holding part 26. In this manner, the held part 51 securely comes into contact with the contact parts 28 of each holding part 26, and for example, a lower side of the held part 51 securely comes into contact with the lower contact part 28*b* and an upper side of the held part 51 comes into contact with the upper contact part 28*a*. Therefore, it is possible to restrain the vibration of the fixing unit 13 by efficiently utilizing the elasticity of the contact parts 28 (upper contact part 28*a* and lower contact part 28*b*).

Although the embodiment was described as to a configuration in which an elastically deformable contact parts 28 is provided at a respective one of one or more holding parts 26 to be provided in the holding frame 25 of the main body frame 20, in another difference embodiment, an elastically deformable contact part 28 may be provided at least at one holding part 26 of one or more holding parts 26.

Although the embodiment was described as to a case in which a heating member 31 is employed as a heating roller including a heat source 31*a* therein, in another different embodiment, a heating member including a fixing belt or a heating member externally provided with a heat source such as an IH coil may be employed.

Although the embodiment was described as to a case of applying a configuration of the present disclosure to a color printer 1, in another different embodiment, it is also possible to apply the configuration of the present disclosure to an image forming apparatus other than the color printer 1, such as a monochrome printer, a copying machine, a facsimile, or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a fixing unit fixing a toner image on a recording medium; and an apparatus main body to which the fixing unit is attached, wherein the apparatus main body includes a holding part which has:

an opening which is arranged at an attachment position of the fixing unit; and an elastically deformable contact part protruding from an edge of the opening to an attachment direction of the fixing unit and bent so as to narrow the opening, and the fixing unit includes a held part protruding at a position corresponding to the holding part, and the held part enters the opening while pressing the contact part so that the held part fits into the opening.

2. The image forming apparatus according to claim 1, wherein the apparatus main body includes a holding frame at which the holding part is arranged, and the fixing unit includes a fixing frame at which the held part is arranged.

3. The image forming apparatus according to claim 1, wherein the held part is formed in a plate shape and extends so as to come into contact with the contact part.

4. The image forming apparatus according to claim 1, wherein the contact part includes:

an upper contact part protruding from an upper edge of the opening and bent so as to narrow the opening from an upper side; and a lower contact part protruding from a lower edge of the opening and bent so as to narrow the opening from a lower side.

5. The image forming apparatus according to claim 4, wherein the upper contact part extends from the upper edge of the opening to the attachment direction so as to incline downward, and the lower contact part extends from the lower edge of the opening to the attachment direction so as to incline upward.

6. The image forming apparatus according to claim 5, wherein an upper face of a distal end of the held part extends to the attachment direction so as to incline downward, and a lower face of the distal end of the held part extends to the attachment direction so as to incline upward.

7. The image forming apparatus according to claim 1, wherein the fixing unit includes:

a rotatable heating member; and a rotatable input gear transmitting rotation drive force to the heating member, and the apparatus main body includes a rotatable drive gear inputting the rotation drive force to the input gear, and the held part is arranged at an end of the fixing unit in a tangential direction of the drive gear and the input gear so as to protrude to the tangential direction.

* * * * *